US012678684B2

(12) United States Patent
Pérez

(10) Patent No.: US 12,678,684 B2
(45) Date of Patent: Jul. 14, 2026

(54) TRAINING DEVICE FOR CUE SPORTS

(71) Applicant: Pedro L. Pérez, Sarasota, FL (US)

(72) Inventor: Pedro L. Pérez, Sarasota, FL (US)

( * ) Notice: Subject to any disclaimer, the term of this patent is extended or adjusted under 35 U.S.C. 154(b) by 224 days.

(21) Appl. No.: 18/229,405

(22) Filed: Aug. 2, 2023

(65) Prior Publication Data

US 2025/0041706 A1 Feb. 6, 2025

(51) Int. Cl.
*A63D 15/00* (2006.01)

(52) U.S. Cl.
CPC ..... *A63D 15/006* (2013.01)

(58) Field of Classification Search
CPC ..... A63D 15/006
USPC ..... 473/2
See application file for complete search history.

(56) References Cited

U.S. PATENT DOCUMENTS

| | | | | |
|---|---|---|---|---|
| 1,783,211 | A | 12/1930 | Baldwin | |
| 3,851,876 | A | 12/1974 | Baker | |
| 3,899,179 | A | 8/1975 | Mach | |
| 3,947,026 | A | 3/1976 | Scoutten | |
| 4,268,033 | A * | 5/1981 | Fontaine | A63D 15/006 473/2 |
| 6,132,319 | A | 10/2000 | Schluter | |
| 6,364,783 | B1 | 4/2002 | Kellogg, Jr. et al. | |
| 6,761,643 | B2 | 7/2004 | Boatwright | |
| 7,147,566 | B2 | 12/2006 | Keating | |
| 7,335,110 | B2 | 2/2008 | Tucker | |
| 7,429,217 | B1 | 9/2008 | Lawrence | |
| 7,476,157 | B1 | 1/2009 | Bertilson | |
| 7,658,680 | B2 | 2/2010 | Malak | |
| 9,044,666 | B2 | 6/2015 | Cameron | |
| 11,389,715 | B1 | 7/2022 | Giribaldo | |
| 2004/0224780 | A1 | 11/2004 | Nagle | |
| 2009/0111594 | A1 * | 4/2009 | Spence | A63D 15/006 473/2 |
| 2025/0041706 | A1 * | 2/2025 | Pérez | A63D 15/105 473/2 |

FOREIGN PATENT DOCUMENTS

| | | | | |
|---|---|---|---|---|
| GB | 2224945 A | * | 5/1990 | A63D 15/006 |

* cited by examiner

*Primary Examiner* — Mitra Aryanpour
(74) *Attorney, Agent, or Firm* — Olav M. Underdal; IDP Patent Services

(57) ABSTRACT

A cue sports training device, including a ball cap piece; a strike portion with a strike indicator that is vertically rotatable from folded-up to a folded-down configuration, a direction member with a direction indicator that is horizontally rotatable to enable adjustment of a deviation angle; such that an intended direction of the object ball is indicated by the direction indicator of the direction member when a cue ball impacts with the strike indicator after the cue ball follows a target direction to the strike indicator.

25 Claims, 14 Drawing Sheets

Cue Sports Training System

Cue Sports Training Device

TRAINING DEVICE FOR CUE SPORTS

CROSS-REFERENCE TO RELATED APPLICATIONS

N/A.

FIELD OF THE INVENTION

The present invention relates generally to the field of cue sports, and more particularly to methods and devices for practicing cue sports targeting angles.

BACKGROUND OF THE INVENTION

Cue sports, such as pool and billiards, are continuing to grow in popularity both for home use, in commercial establishments, and in amateur and professional leagues.

However, learning how to target the cue ball on an object ball with the appropriate angle, depending on the intended direction of the object ball, remains difficult to accomplish for novice and intermediate players.

Some devices have been made available to aid in targeting angle practice, but they have suffered from limited ability to customize and adapt to training needs of more sophisticated players.

As such, considering the foregoing, it may be appreciated that there continues to be a need for novel and improved devices and methods for targeting angle training devices for cue sports.

SUMMARY OF THE INVENTION

The foregoing needs are met, to a great extent, by the present invention, wherein in aspects of this invention, enhancements are provided to the existing model of for targeting angle training devices for cue sports.

In an aspect, a cue sports training device can include:

a) a ball cap piece, which is positionable on an object ball; and b) a strike portion, which comprises:

i. a strike body; and ii. a strike indicator;

wherein a front end of the strike body of the strike portion is connected to a rear of the ball cap piece;

wherein the strike indicator is connected to a rear end of the strike body;

such that the strike indicator is positionable such that a horizontal center plane of the strike indicator is coincidental with a horizontal center plane of the object ball, when the ball cap piece is positioned on the object ball;

c) a direction member, which comprises:

i. a direction body; and ii. a direction indicator;

wherein the direction member is connected to a front of the ball cap piece;

wherein the direction indicator is connected to an outer end of the direction body;

such that an intended direction of the object ball is indicated by the direction indicator of the direction member when the cue ball impacts with the strike indicator after the cue ball follows a target direction to the strike indicator, wherein a horizontal center plane of the strike indicator can be coincidental with a horizontal center plane of the cue ball.

In a related aspect, the strike body can further include:

a) a first strike member, which is configured to protrude to the rear of the ball cap piece; and b) a second strike member, such that an inner end of the second strike member is hingedly and vertically rotatably connected to an outer end of the first strike member, and such that the strike indicator is connected to an outer end of the second strike member;

such that the second strike member is rotatable to a folded-down first configuration with the horizontal center plane of the strike indicator coincidental with the horizontal center plane of the object ball, when the ball cap piece is positioned on the object ball; and such that the second strike member is rotatable to a folded-up second configuration, for use in practice use without the aid of the strike indicator.

In another related aspect, the direction member can be horizontally rotatably connected to the ball cap piece, such that a deviation angle of the direction member is adjustable, whereby adjustment of the deviation angle can enable practice with spin-induced adjustment of the intended direction of the object ball.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
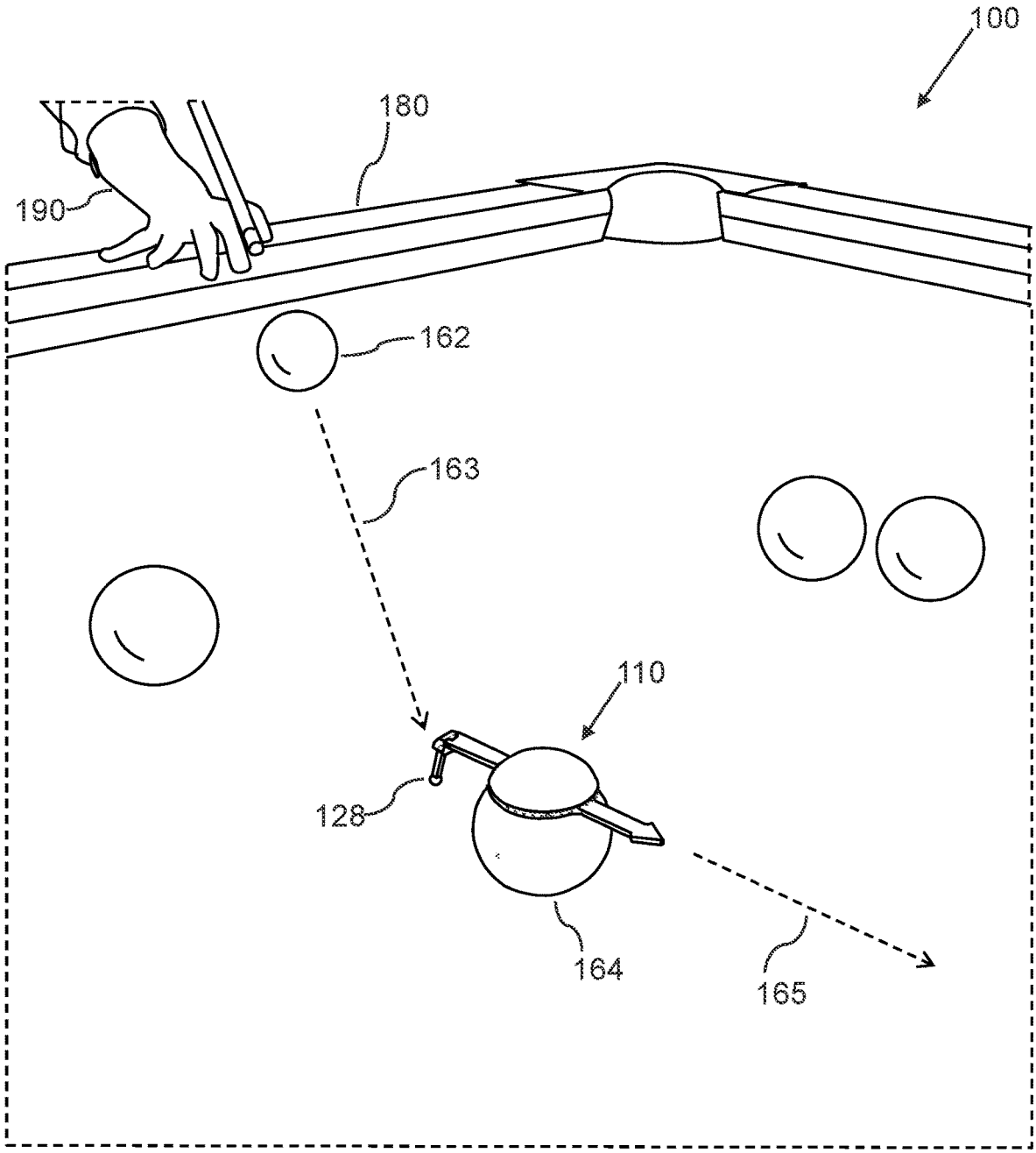
FIG. 1 is a perspective view of a cue sports training system, including a cue sports training device, a cue sports table, a cue ball, and an object ball, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a cue sports training system 100 which can include a cue sports training device 110, a cue sports table 180, a cue ball 162, and at least one object ball 164, with reference to FIGS. 1 and 2A-2F, in such manner that like reference numerals refer to like components throughout; a convention that we shall employ for the remainder of this specification.

In an embodiment, as shown in FIGS. 1, 2A-2B, and 7A-7B, a cue sports training device 110, for use in cue sports such as pool and billiards, can include:

a) a ball cap piece 215, 715, which is configured to be positioned on an object ball 164; and b) a strike portion 220, which comprises:

i. a strike body 222; and ii. a strike indicator 128;

wherein a front end of the strike body 222 of the strike portion 220 is connected to a rear end of the ball cap piece 215;

wherein the strike indicator is connected to a rear end of the strike body 222;

such that the strike indicator 128 is positionable such that a horizontal center plane 525 of the strike indicator 128 is coincidental with a horizontal center plane 565 of the object ball 164, when the ball cap piece 215 is positioned on the object ball 164; and c) a direction member 230, 730, which comprises:

i. a direction body 232; and ii. a direction indicator 234;

wherein the direction member 230 is connected to a front end of the ball cap piece 215;

wherein the direction indicator 234 is connected to an outer end of the direction body 232;

such that an intended object ball direction 165 of the object ball 164 is indicated by the direction indicator 234 of the direction member 230 when the cue ball 162 impacts with the strike indicator 128 after the cue ball follows a target direction 163 to the strike indicator 128, wherein a horizontal center plane of the strike indicator can be coincidental with a horizontal center plane of the cue ball 162, such that the cue sports training device 110 (which is relatively light-weight and typically molded from a plastic material) is "flicked off" (aka "flipped off") the object ball 164, i.e. flies away from the object ball 164, at the point of cue ball 162 impact with the strike indicator 128 with negligible impact on the trajectory of the cue ball 162 (due to the relatively low mass of the cue sports training device 110 compared to the cue ball 162).

Thus, in various related embodiments, methods of use of the cue sports training system 100 and the cue sports training device 110 can include that a player 190 practices targeting for the cue ball 162 to center impact the strike indicator 128 along a target direction 163, such that the object ball 164 rolls in the intended object ball direction 165 after impact with the cue ball 162 (when there is no or negligible side spin 682, 684 applied to the cue ball 162), in order to for example target a pocket of the cue sports table 180, a secondary object ball 164, or a cushioned side of the cue sports table 180 (as a part of a "bank shot"); for example as a single shot or a combination shot combining several elements, such as a bank shot of a first object ball 162, followed by pocketing of a secondary object ball 162.

Figure 2A:
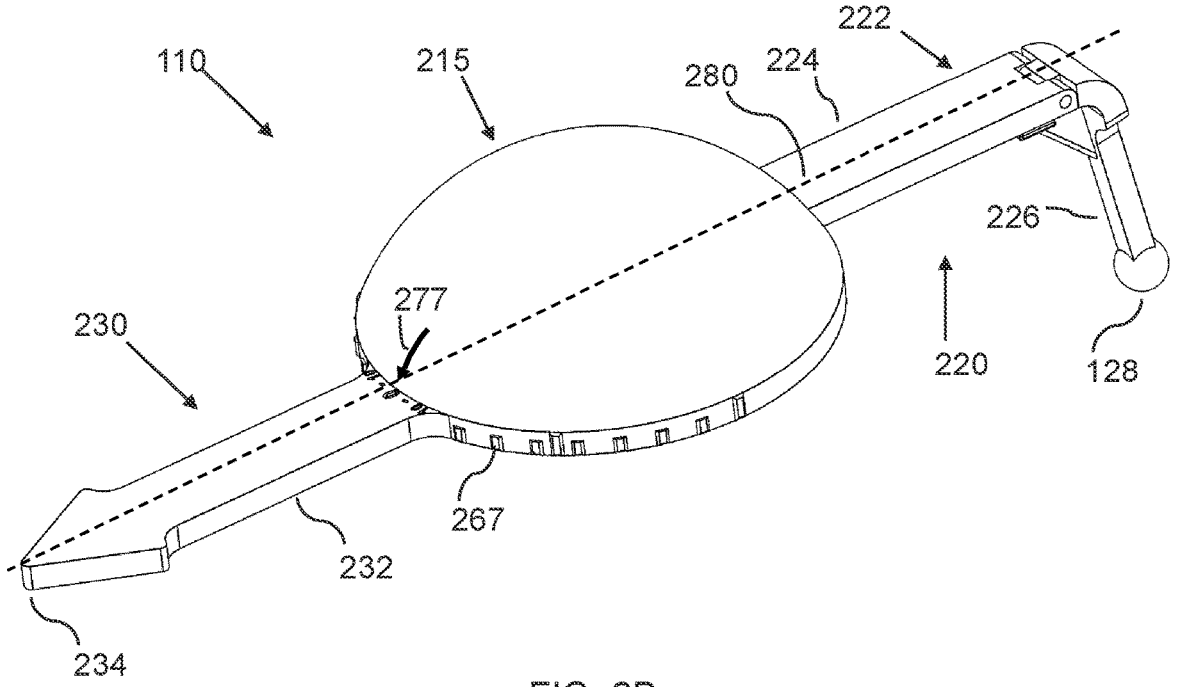
FIG. 2A is a top front perspective view of a cue sports training device, according to an embodiment of the invention.
Figure 2B:
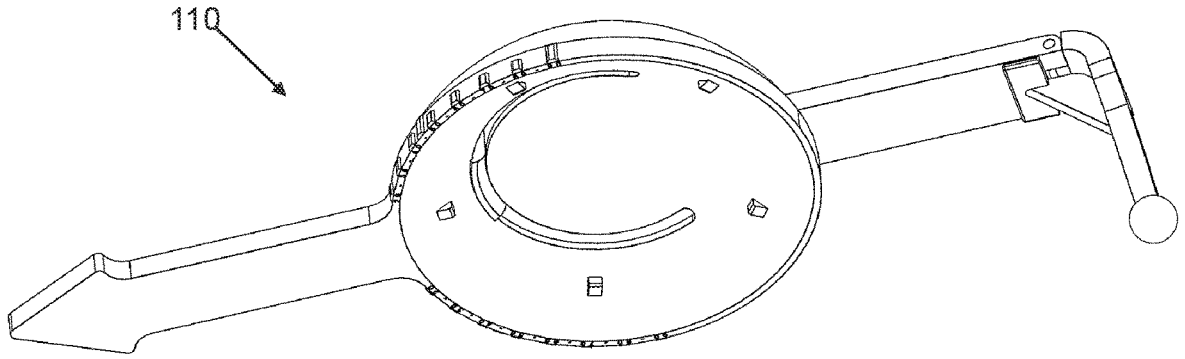
FIG. 2B is a bottom rear perspective view of a cue sports training device, according to an embodiment of the invention.
Figure 2C:
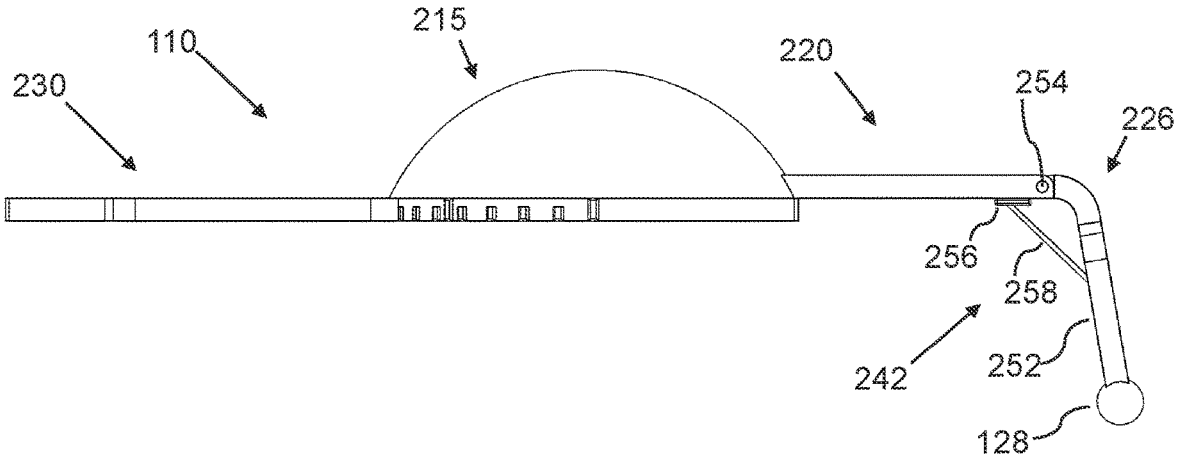
FIG. 2C is a side view of a cue sports training device with a strike indicator in a folded-down first configuration, according to an embodiment of the invention.
Figure 2D:
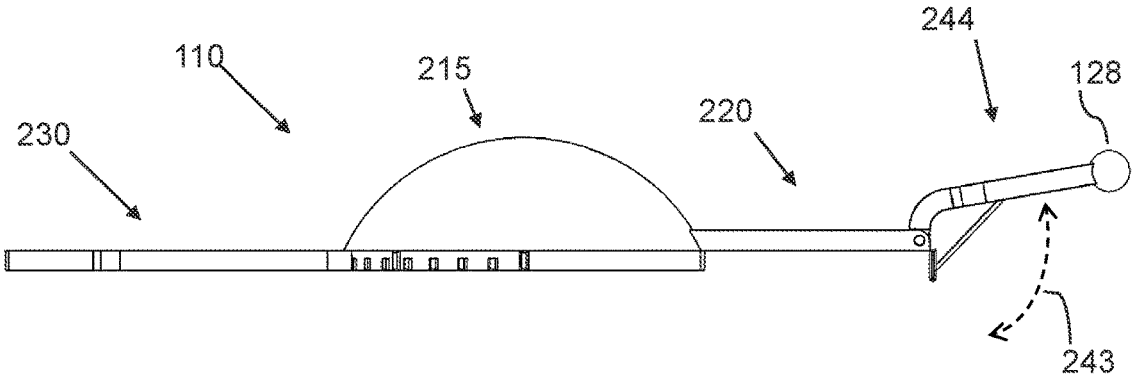
FIG. 2D is a side view of a cue sports training device with a strike indicator in a folded-up second configuration, according to an embodiment of the invention.
Figure 2E:
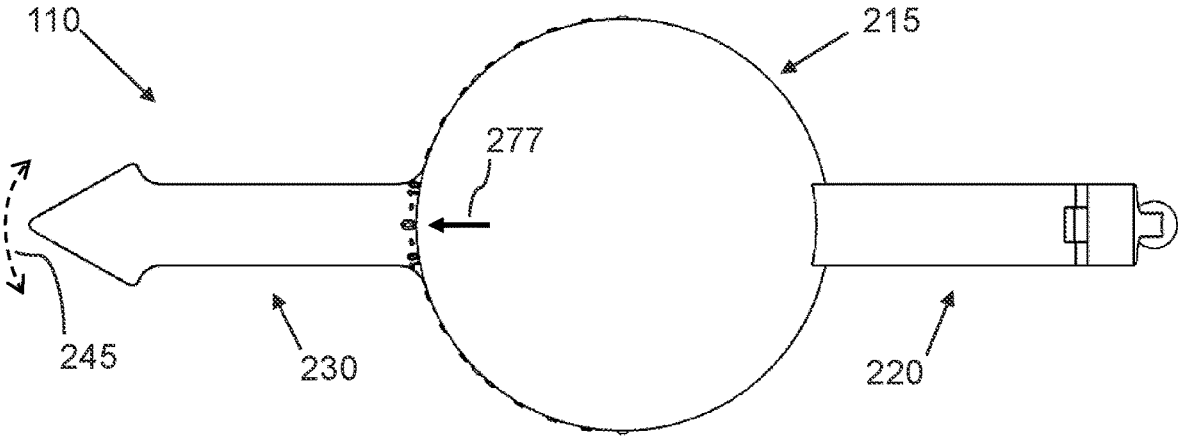
FIG. 2E is a top view of a cue sports training device, according to an embodiment of the invention.

In a further related embodiment, as shown in FIGS. 2C and 2D, the strike indicator 128 can be vertically rotatably 243 connected to the ball cap piece 215 (via the strike body 222);

such that the strike indicator 128 is vertically rotatable 243 to a folded-down first configuration 242, such that a horizontal center plane 525 of the strike indicator 128 is coincidental with the horizontal center plane 565 of the object ball 164, when the ball cap piece 215 is positioned on the object ball 164; and such that the strike indicator 128 is vertically rotatable 243 to a folded-up second configuration 244, for practice use without the aid of the strike indicator 128.

In a related embodiment, the strike body 222 can further include:

a) a first strike member 224, which is configured to protrude to the rear of the ball cap piece 215; and b) a second strike member 226, such that an inner end of the second strike member 226 is hingedly and vertically rotatably 243 connected to an outer end of the first strike member 224, and such that the strike indicator 128 is connected to an outer end of the second strike member 226;

such that the second strike member 226 is vertically rotatable 243 to a folded-down first configuration 242 with the horizontal center plane 525 of the strike indicator 128 coincidental with the horizontal center plane 565 of the object ball 164, when the ball cap piece 215 is positioned on the object ball 164; and such that the second strike member 226 is vertically rotatable 243 to a folded-up second configuration 244, for practice use without the aid of the strike indicator 128.

In a further related embodiment, the second strike member 226 can further include:

a) an elongated strike portion 252, wherein the strike indicator 128 is connected to an outer end of the elongated strike portion 252;

b) a hinge connector 254, which is connected to an outer end of the elongated strike portion 252, wherein the hinge connector 254 is configured to hingedly connect with a corresponding hinge connector 225 of the outer end of the first strike member 224;

c) a stop member 256, which is connected to an outer end of the elongated strike portion 252 below the hinge connector 254, wherein the stop member 256 can be configured as a stop plate, such that the stop member is configured to stop a rotation 243 of the second strike member 226, when the stop member 256 impacts with the first strike member 224, such that the stop member 256 provides structural support when the cue ball 162 impacts with the strike indicator 128; and d) a support flange 258, which is connected between the elongated strike portion 252 and the stop member 256, such that the stop member is configured to provide additional structural support.

In a yet further related embodiment, as shown in FIGS. 4A-4F, the direction member 230 can further include:

a) a lower ball cap member 460, which is configured to be positioned on an object ball 164, wherein the lower ball cap member 460 can further include:

i. a lower cap body 462, which can be substantially shaped as an upper section of a sphere, wherein the lower cap body 462 comprises:

1) an elongated opening 464, which is shaped as a circle segment;

ii. a plurality of at least three ball support members 466, which are uniformly (equidistantly along a circle) mounted on an inside of the lower cap body 462, to provide support for the object ball 164 and provide a separation between the object ball 164 and the lower cap body, wherein, as shown, the plurality of at least three ball support members 466 can be five ball support members 466; and iii. an outer rim 468, which is connected to (i.e., around) an outer periphery of the lower cap body 462.

Figure 6A:
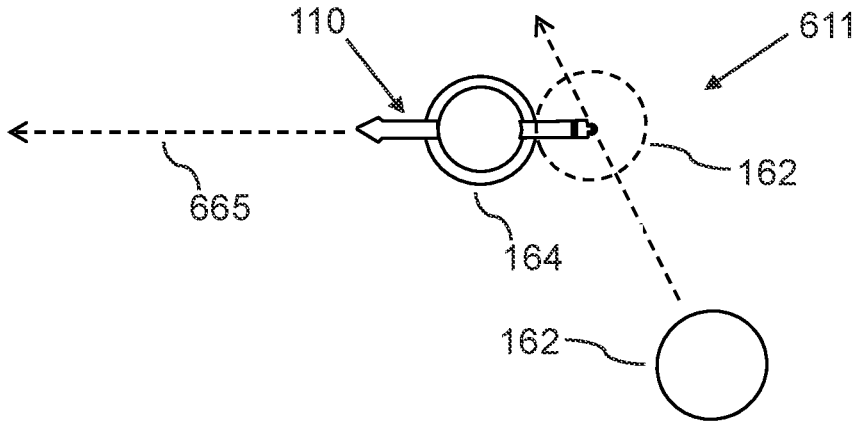
FIG. 6A is a top view of a first scenario of targeting a cue sports training device mounted on an object ball, wherein the cue ball has no spin, according to an embodiment of the invention.
Figure 6B:
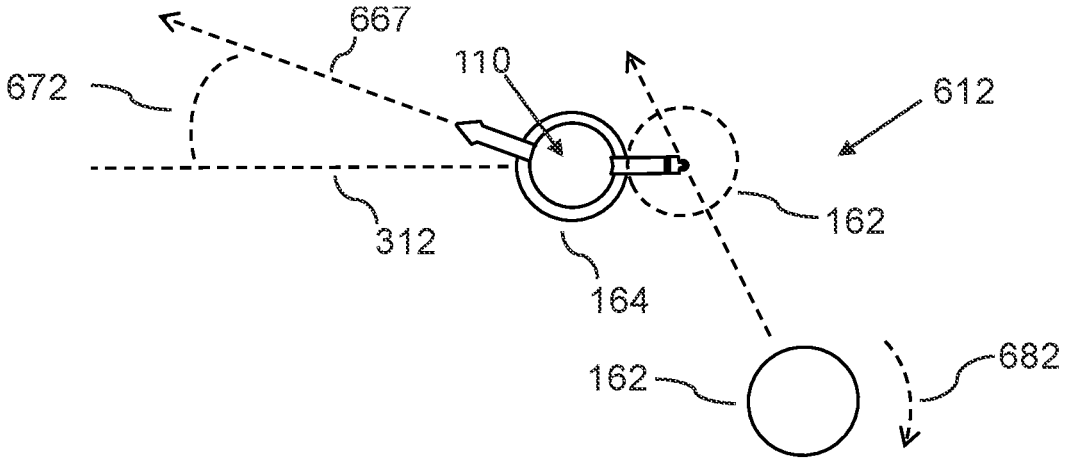
FIG. 6B is a top view of a second scenario of targeting a cue sports training device mounted on an object ball, wherein the cue ball has a predetermined clockwise right spin, according to an embodiment of the invention.
Figure 6C:
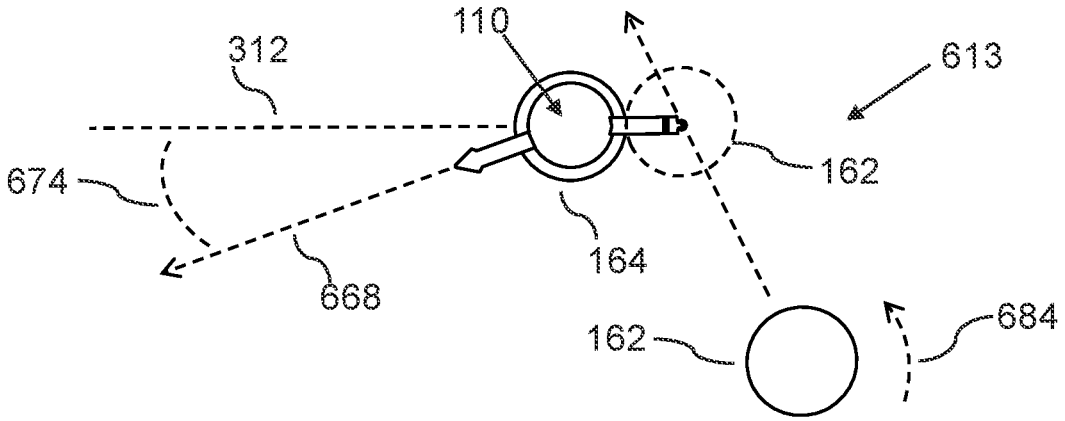
FIG. 6C is a top view of a third scenario of targeting a cue sports training device mounted on an object ball, wherein the cue ball has a predetermined clockwise left spin, according to an embodiment of the invention.

In a further related embodiment, as shown in FIGS. 2E and 3A-3D, the direction member 230 can be horizontally rotatably 245 connected to the ball cap piece 215, such that a deviation angle 374, 375 of the direction member 230 (between a longitudinal centerline 312 of the cue sports training device 110 and a longitudinal centerline 314 of the direction member 230) is adjustable, whereby adjustment of the deviation angle 374, 375 can enable practice with side-spin-induced adjustment (i.e., "throwing") of the intended object ball direction 165 of the object ball 164, as shown in FIGS. 6B and 6C.

In a yet further related embodiment, as shown in FIGS. 4A-4D, the strike portion 220 can further include:

a) an upper ball cap member 470, which is configured to be positioned on a top of the lower ball cap member 460, wherein the upper ball cap member 470 can further include:

i. an upper cap body 472, which can be substantially shaped as an upper section of a sphere, such that a lower peripheral edge of the upper cap body 472 is configured to rest on the outer rim 468 of the lower ball cap member 460; and ii. a downward protruding member 474, comprising:

i. a protruding body 476, wherein a top end of the protruding body 476 is connected to a bottom surface of the upper cap body 472; and ii. a hook portion 478, which is connected to a lower end of the protruding body;

such that the hook portion 478 is configured to protrude through the elongated opening 464 of the lower cap body 462 and lock in place on an edge of the elongated opening 464, such that the hook portion 478 is slidably mounted in the elongated opening 464, such that the upper ball cap member 470 and the lower ball cap member 460 are horizontally rotatably 245 connected together; such that the upper ball cap member 470 and the lower ball cap member 460 in connected combination form the ball cap piece 215;

such that a deviation angle 374, 375 of the direction member 230 (between a longitudinal centerline 312 of the cue sports training device 110 and a longitudinal centerline 314 of the direction member 230) is adjustable, whereby adjustment of the deviation angle 374, 375 can enable practice with spin-induced adjustment of the intended object ball direction 165 of the object ball 164, as shown in FIGS. 6B and 6C.

In a related embodiment, the lower ball cap member 460 can further comprise:

a) a plurality of position apertures 469 equidistantly positioned around an upper periphery of the lower ball cap member 460, such as around an upper surface of the outer rim 468; and b) wherein the upper ball cap member 470 further comprises:

i. a locking protrusion 479, such that each position aperture 469 in the plurality of position apertures 469 is configured to receive the locking protrusion 479;

such that the deviation angle 374, 375 of the direction member 230 is adjustable in steps.

In a related embodiment, the lower ball cap member 460 can further comprise:

a) a plurality of angle markers 267 equidistantly positioned around a periphery of the lower ball cap member 460, such as around a side surface of the outer rim 468, such that the angle markers 267 indicate the deviation angle 374, 375; and b) wherein the upper ball cap member 470 further comprises:

i. a straight position marker 277, which can be an arrow pointing along an elongated center axis 280 of the cue sports training device 110;

such that the deviation angle 374, 375 is measurable by an indicated angle marker 267, which is indicated by the straight position marker 277.

In various related embodiments, as shown in FIG. 2A, the plurality of angle markers 267 can each be printed, indented, embossed, or a combination of these.

In other various related embodiment, the ball cap piece 215, 715, the upper cap body 472, and the upper cap body 472, can be substantially dome-shaped, or shaped as a segment or cut-out of a sphere, but can also have various other shapes that are configured to adapt to a surface of an object ball.

Figure 2F:
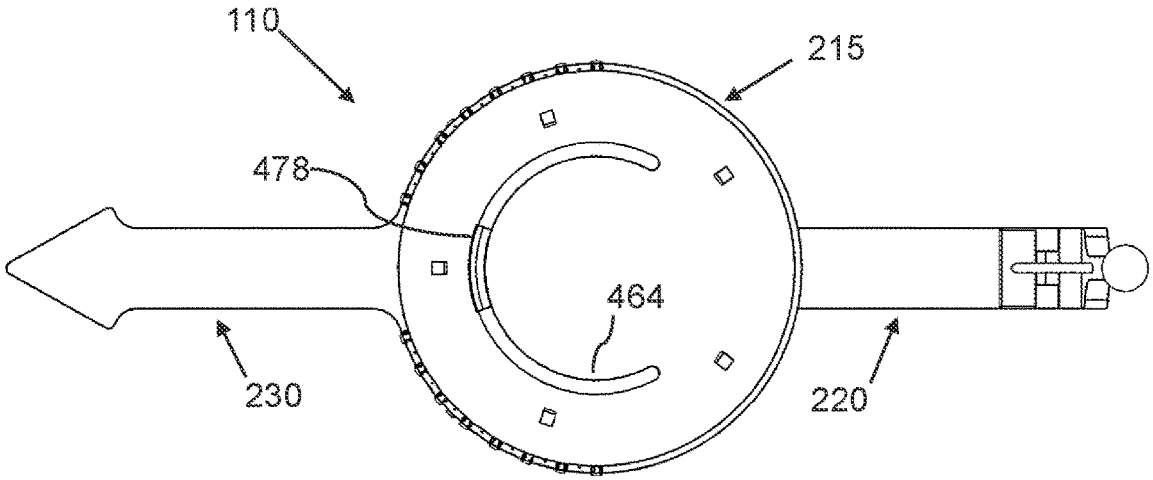
FIG. 2F is a bottom view of a cue sports training device, according to an embodiment of the invention.
Figure 3A:
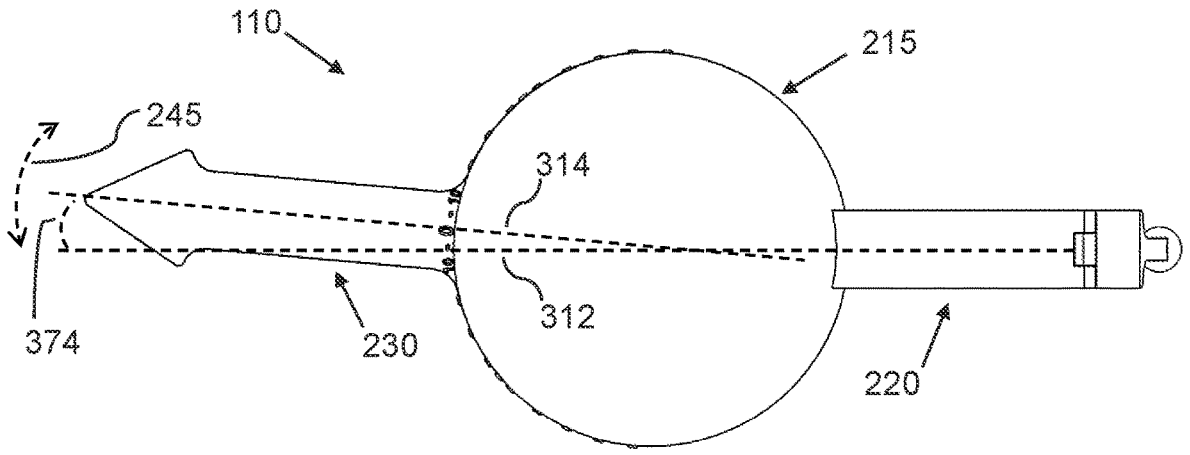
FIG. 3A is a top view of a cue sports training device, according to an embodiment of the invention.
Figure 3B:
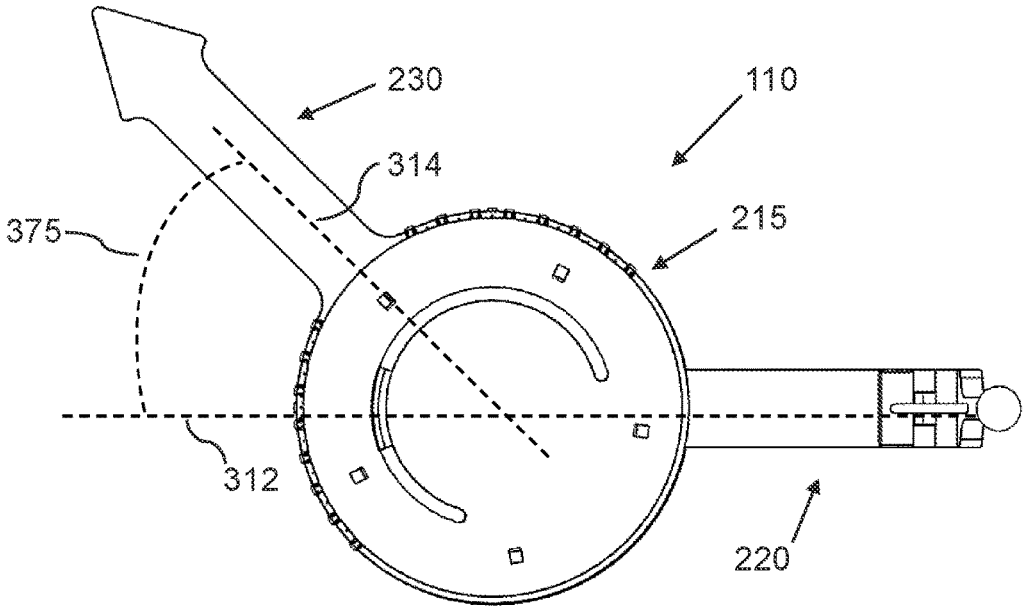
FIG. 3B is a bottom view of a cue sports training device, according to an embodiment of the invention.
Figure 4A:
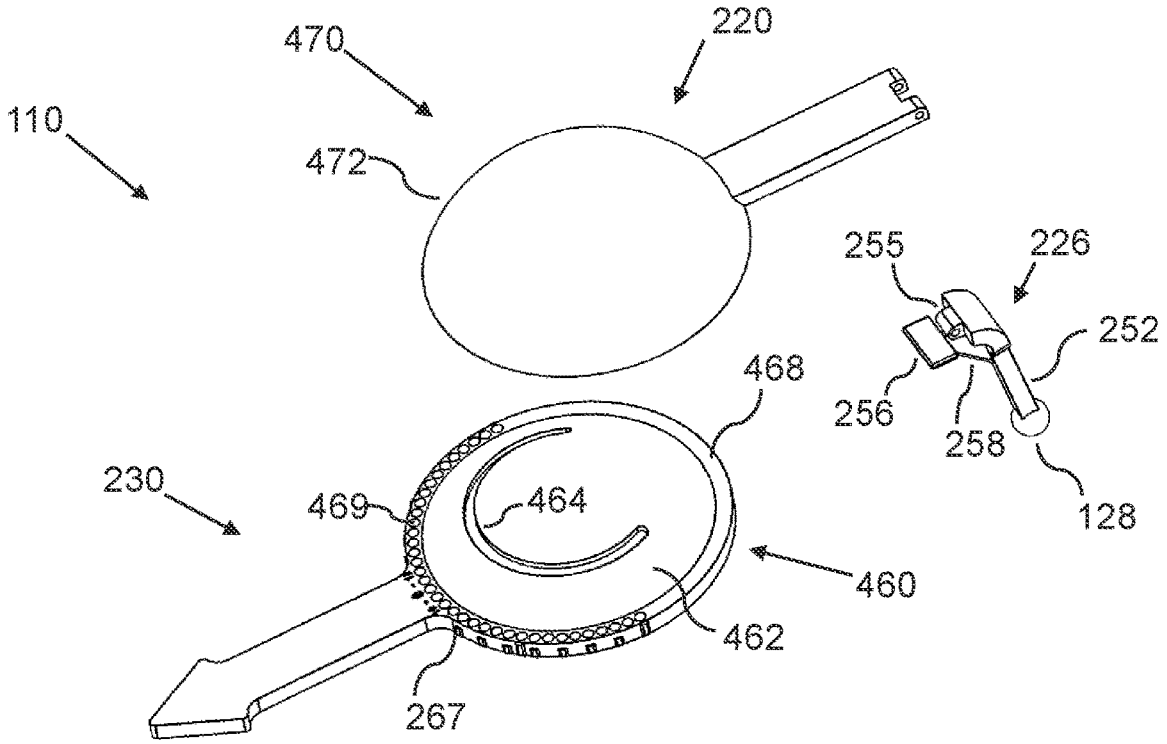
FIG. 4A is an exploded top perspective view of a cue sports training device, according to an embodiment of the invention.
Figure 4B:
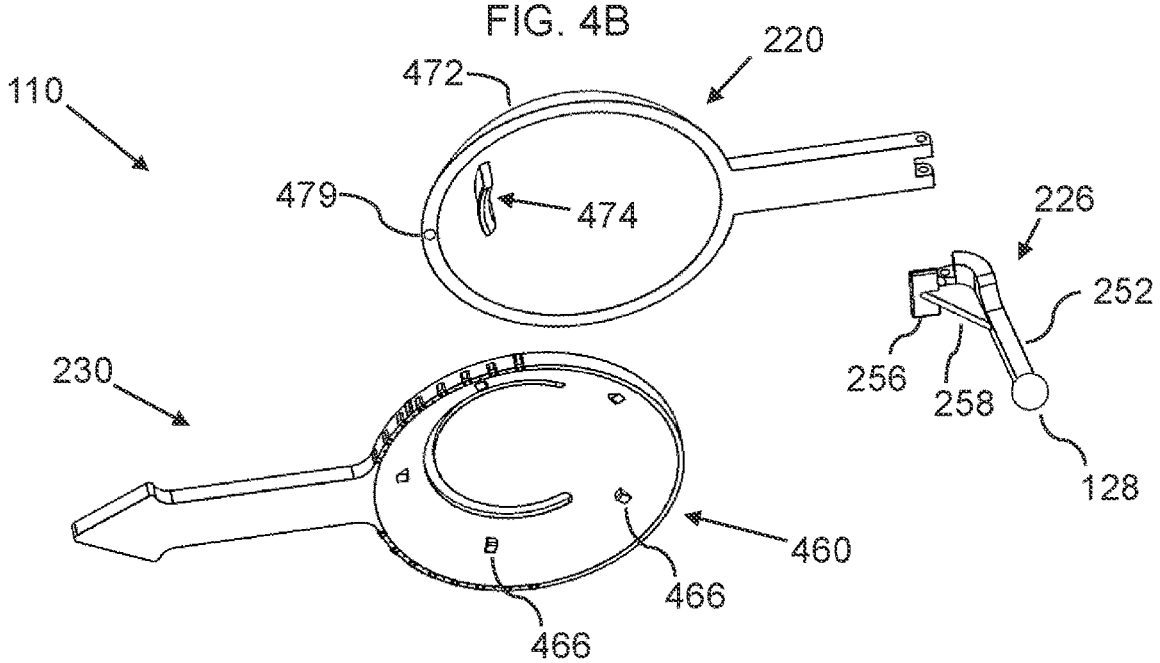
FIG. 4B is an exploded bottom perspective view of a cue sports training device, according to an embodiment of the invention.
Figure 4C:
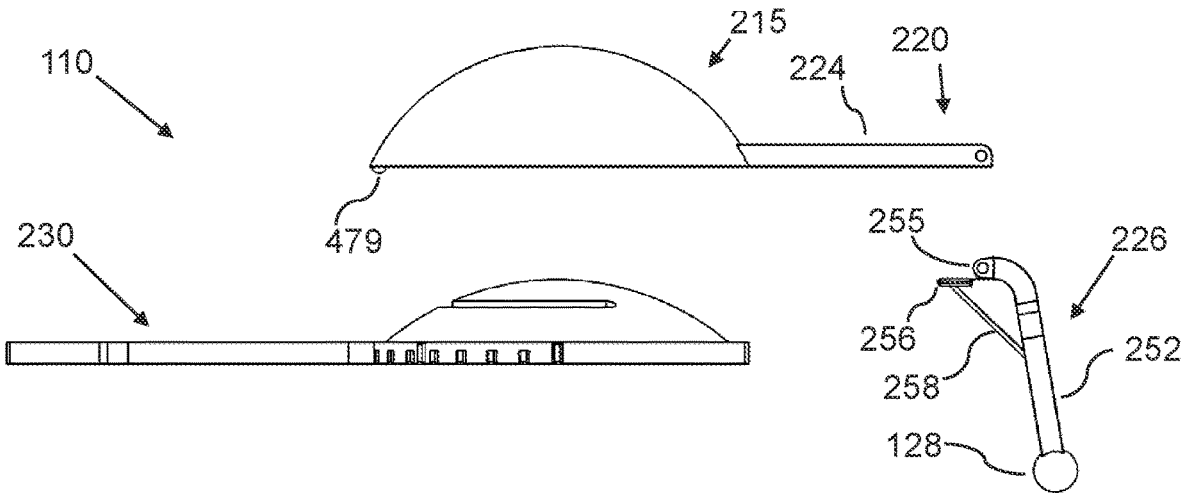
FIG. 4C is an exploded side view of a cue sports training device, according to an embodiment of the invention.
Figure 4D:
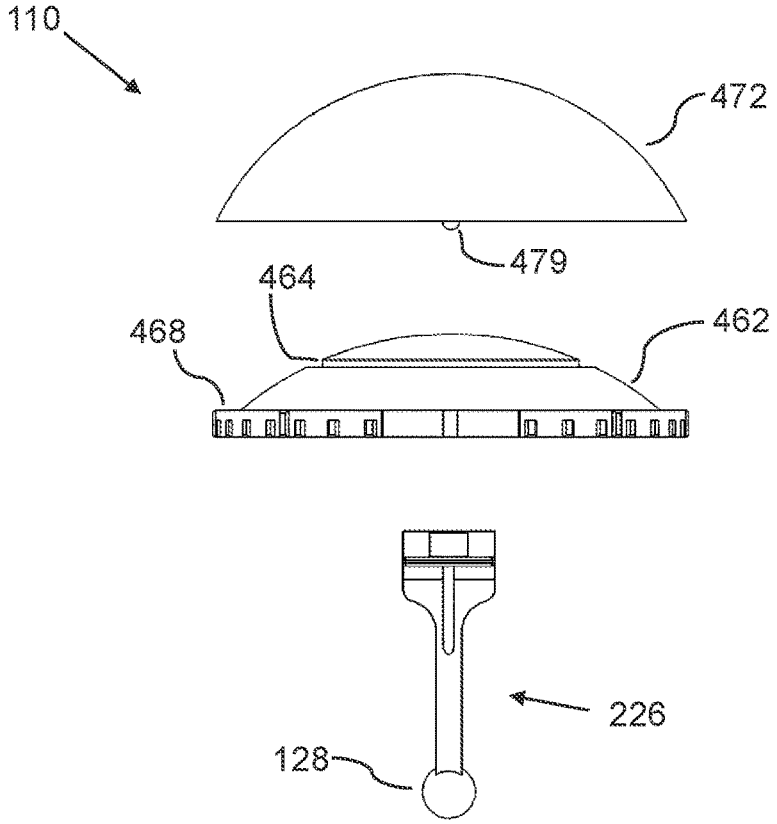
FIG. 4D is an exploded front view of a cue sports training device, according to an embodiment of the invention.
Figure 4E:
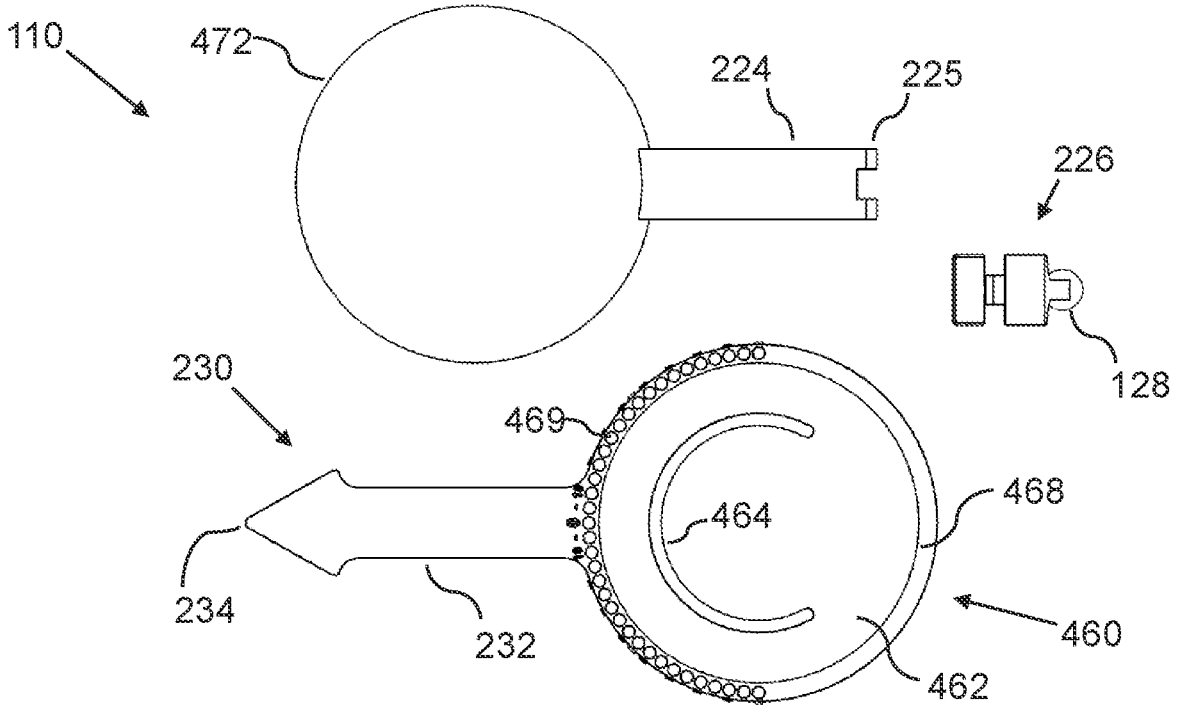
FIG. 4E is an exploded top view of a cue sports training device, according to an embodiment of the invention.
Figure 4F:
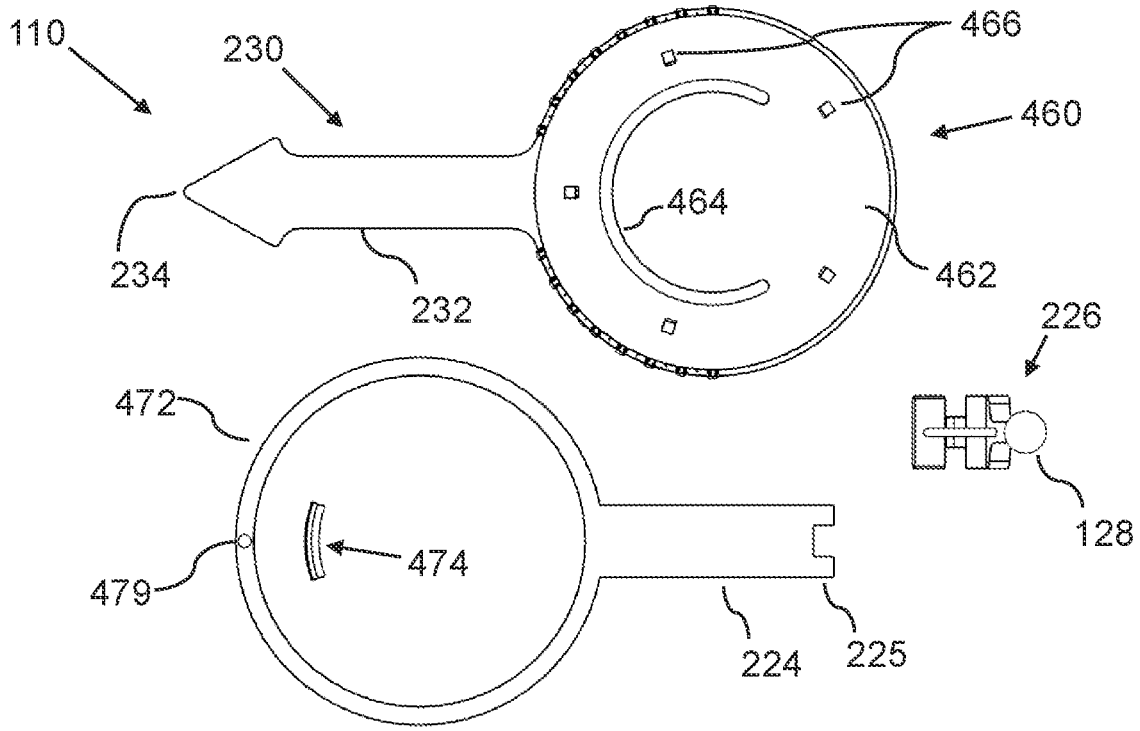
FIG. 4F is an exploded bottom view of a cue sports training device, according to an embodiment of the invention.
Figure 4G:
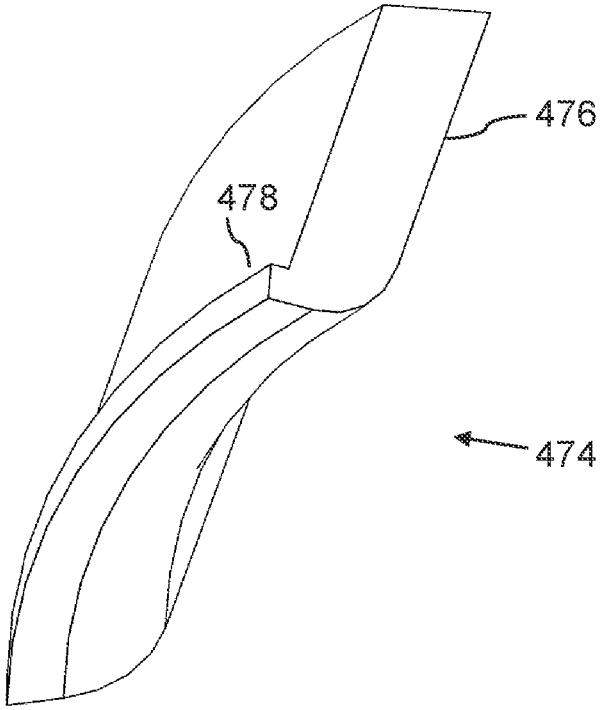
FIG. 4G is a bottom perspective view of a downward protruding member with a hook portion of a cue sports training device, according to an embodiment of the invention.

In a related embodiment, as shown in FIGS. 2F and 4G, the hook portion 478 can be configured to be laterally elongated, such that a curvature of the hook portion 478 matches a curvature of the elongated opening 464 of the lower cap body 462, which ensures a strong grip with minimal friction to enable sliding of the hook portion 478.

Figure 5A:
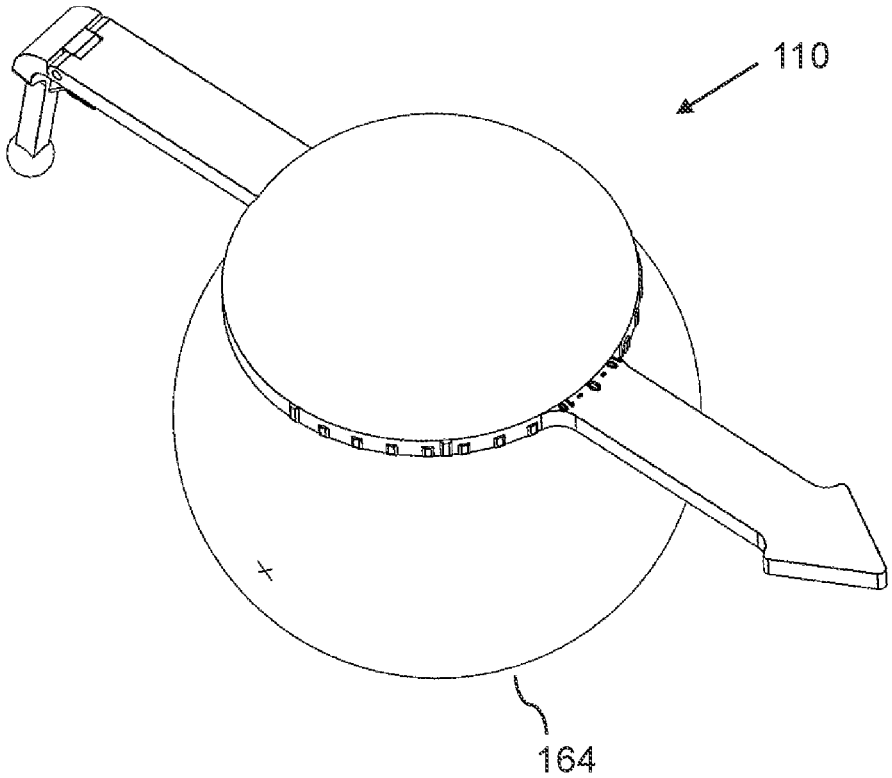
FIG. 5A is a top front perspective view of a cue sports training device mounted on an object ball, according to an embodiment of the invention.
Figure 5B:
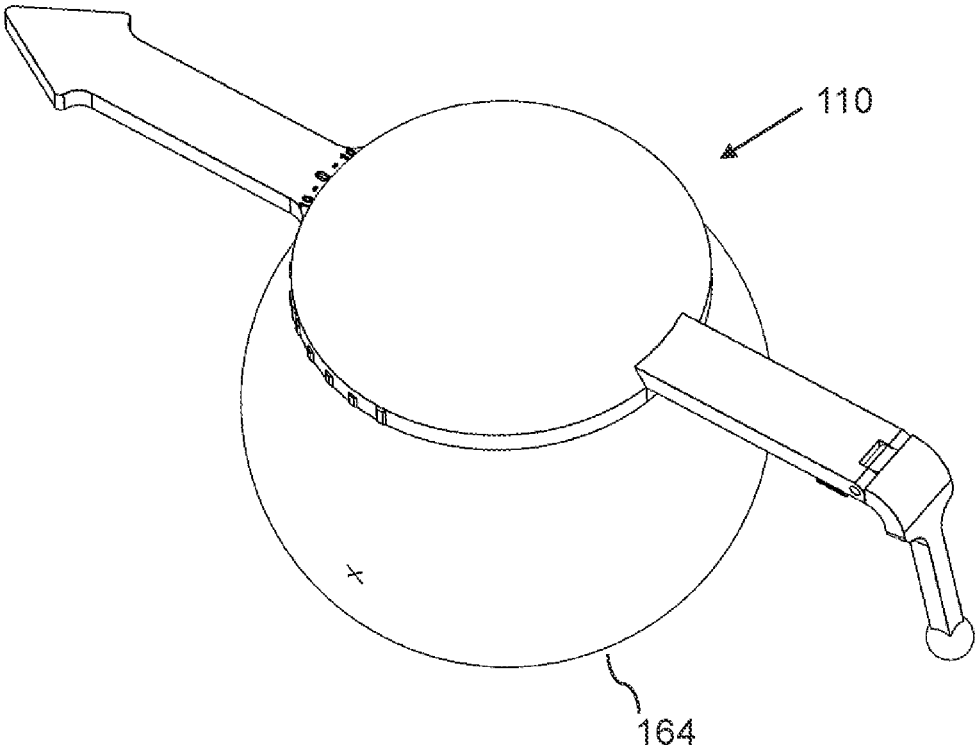
FIG. 5B is a top rear perspective view of a cue sports training device mounted on an object ball, according to an embodiment of the invention.
Figure 5C:
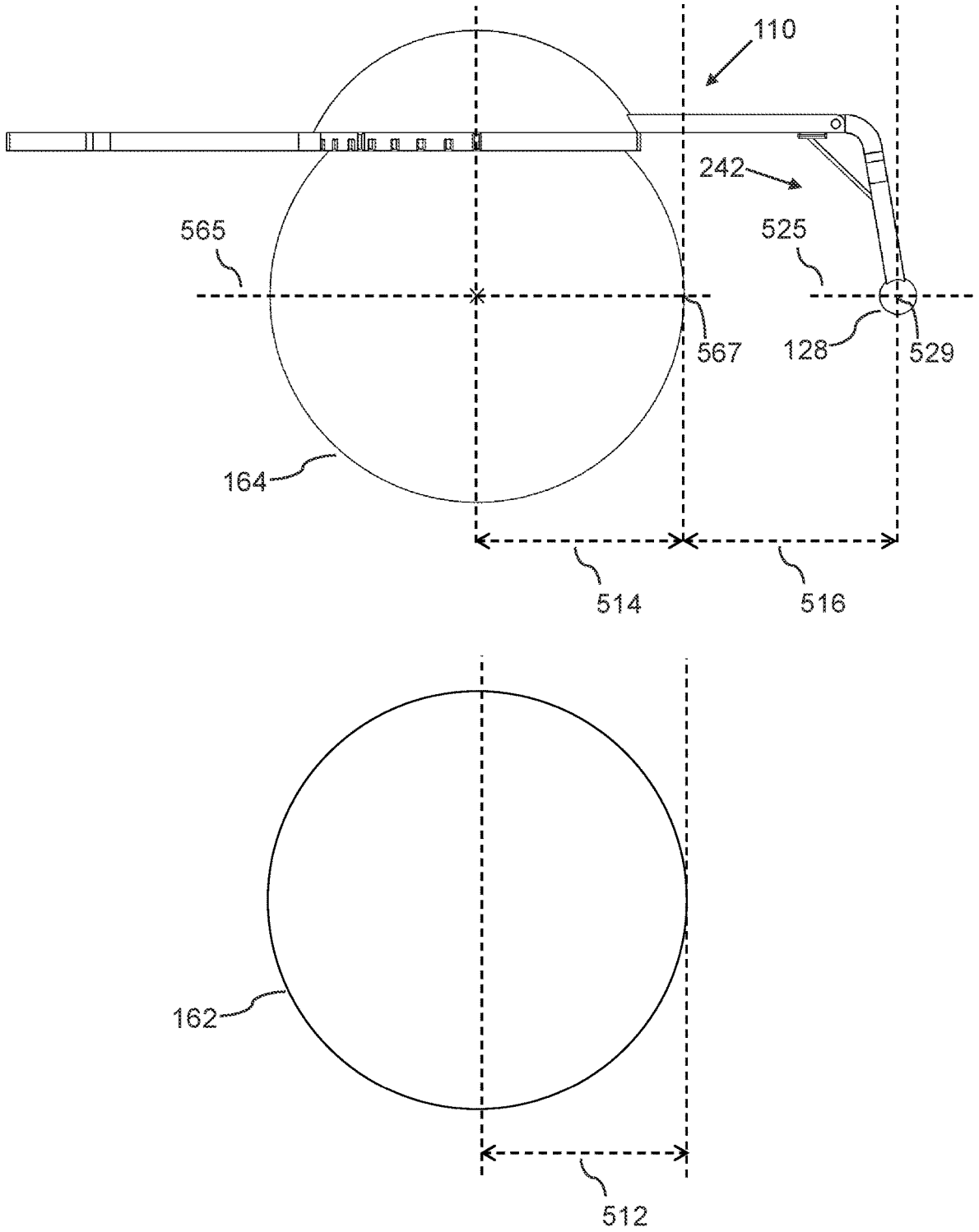
FIG. 5C is a side view of a cue sports training device mounted on an object ball, according to an embodiment of the invention.
Figure 5D:
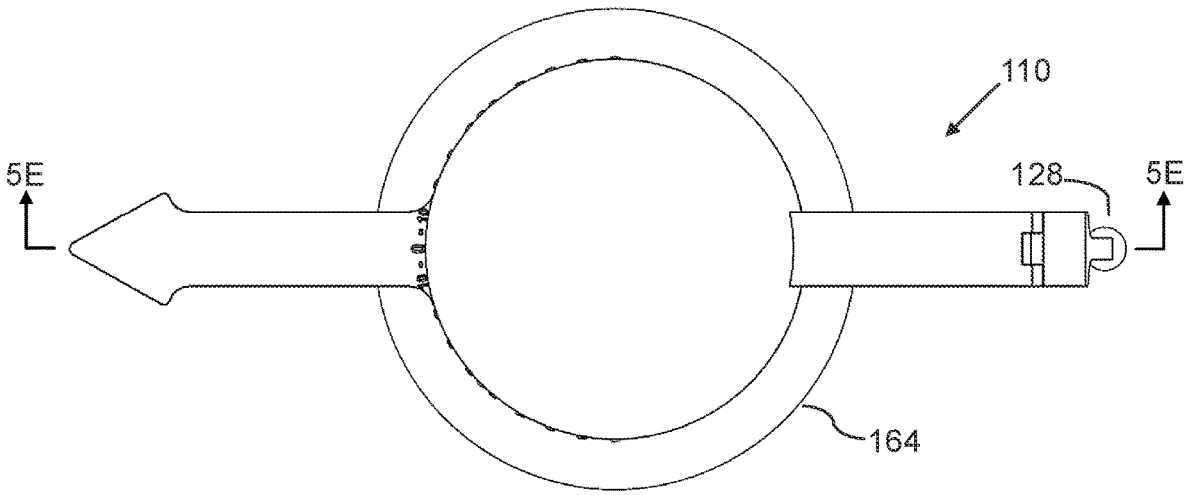
FIG. 5D is a top view of a cue sports training device mounted on an object ball, according to an embodiment of the invention.
Figure 5E:
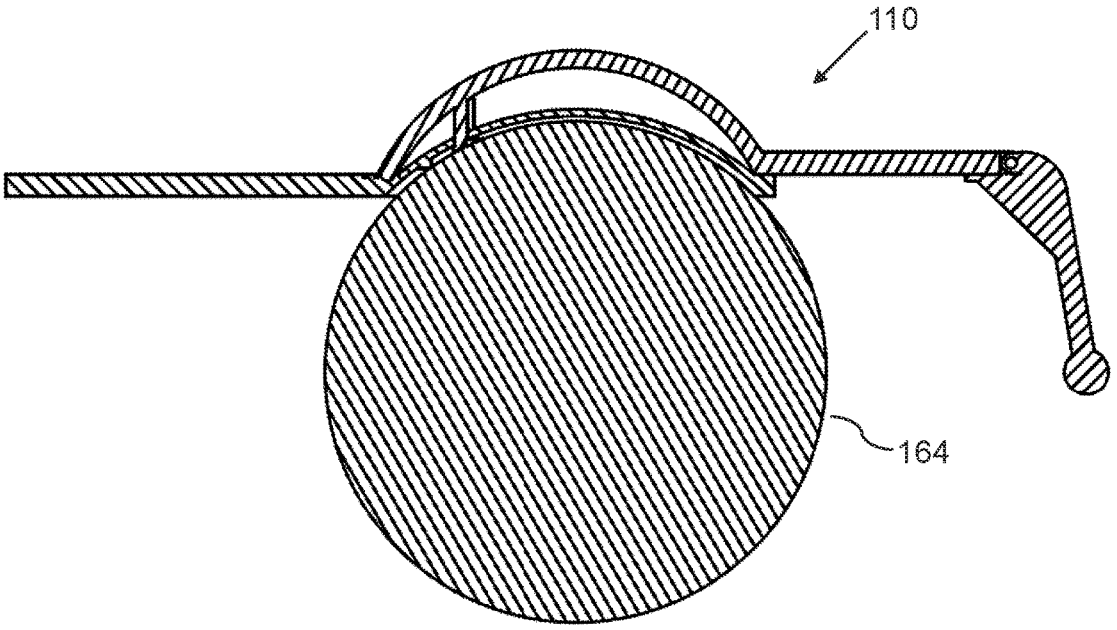
FIG. 5E is a cross sectional view of a cue sports training device mounted on an object ball taken along section line 5E-5E of FIG. 5D, according to an embodiment of the invention.

In another related embodiment, as shown in FIG. 5C, the strike portion 220 can be configured such that a horizontal separation distance 516, between a center point 529 of the strike indicator 128 and a closest edge point 567 of the object ball 164, can be equal to a radius 514 of the object ball 164, when the cue sports training device 110 is positioned on the object ball 164. This is a typical configuration for cue sports games wherein cue balls 162 and object balls 164 have the same size, such as for Carom Billiards and Snooker.

In related embodiments, the horizontal separation distance 516 can be adjusted to be configured to be slightly shorter or longer than a radius 514 of the object ball 164, such as within a range of 90 to 110 percent or 95 to 105 percent of a radius 514 of the object ball 164. Players 190 may adjust for changing conditions including changing cue ball radius 512 by aiming the cue ball 162 in increments slightly to a left or right of the center point 529 of the strike indicator 128.

In yet another related embodiment, a horizontal separation distance 516, between a center point 529 of the strike indicator 128 and the closest edge point 567 of the object ball 164, can be equal to a radius 512 of the cue ball 162, when the cue sports training device 110 is positioned on the object ball 164. This is a typical configuration for cue sports games wherein cue balls 162 and object balls 164 have different sizes, such as for US regulation pool.

In further related embodiments, the cue sports training device 110 can be configured to enable adjustment of a length of the horizontal separation distance 516, such as for example by adjustment of a rotational 243 position of the strike indicator 128, or via a length adjustable strike portion 220, for example by a telescoping first strike member 224 (made by two parts with a slidable connection), or via a telescoping and/or slidable connection between the first strike member 224 and the second strike member 226.

Thus, in various related embodiments, methods of use of the cue sports training system 100 and the cue sports training device 110, can include:

a) Positioning a cue sports training device 110 on an object ball 164, as shown in FIG. 6A, such that the cue sports training device 110 is oriented to point in an intended object ball direction 165, 665, wherein the strike indicator 128 is in the folded-down first configuration 242 and the deviation angle 374, 375 of the direction member 230 is set to zero (i.e. pointing straight), such that a player 190 practices targeting for the cue ball 162 to center impact the strike indicator 128 along a target direction 163, such that the object ball 164 rolls in the intended object ball direction 165 after impact with the cue ball 162 (when there is no or negligible side spin 682, 684 applied to the cue ball 162), in order to for example target a pocket of the cue sports table 180, a secondary object ball, or a cushioned side of the cue sports table 180 (as a part of a "bank shot");

b) Positioning a cue sports training device 110 on an object ball 164, such that the cue sports training device 110 is oriented to point in an intended object ball direction 165, 665, wherein the strike indicator 128 is in the folded-up second configuration 244 and the deviation angle 374, 375 of the direction member 230 is set to zero (i.e. pointing straight), such that the player 190 practices targeting for the cue ball to center impact a perceived target zone (where the strike indicator 128 would have been positioned if folded down) along a target direction 163, such that the object ball 164 rolls in the intended object ball direction 165 after impact with the cue ball 162 (when there is no or negligible side spin 682, 684 applied to the cue ball 162), in order to for example target a pocket of the cue sports table 180, a secondary object ball 162, or a cushioned side of the cue sports table 180 (as a part of a "bank shot");

c) Positioning a cue sports training device 110 on an object ball 164, as shown in FIGS. 6A and 6B, such that the cue sports training device 110 is oriented to point in an intended object ball direction 667, 668, wherein the strike indicator 128 is in the folded-down first configuration 242 with a non-zero positive or negative deviation angle 374, 375, 672, 674 of the direction member 230, such that a player 190 practices targeting for the cue ball 162 to center impact the strike indicator 128 along a target direction 163 with a predetermined non-zero positive or negative side spin 682, 684 applied to the cue ball 162, respectively, such that the object ball 164 rolls in the intended object ball direction 165 after impact with the cue ball 162, wherein the positive or negative side spin 682, 684 causes the ball to be "thrown" corresponding to the positive or negative deviation angle 374, 375, respectively;

d) Positioning a cue sports training device 110 on an object ball 164, such that the cue sports training device 110 is oriented to point in an intended object ball direction 667, 668, wherein the strike indicator 128 is in the folded-down first configuration 242 with a non-zero positive or negative deviation angle 374, 375 of the direction member 230, such that a player 190 practices targeting for the cue ball 162 to center impact a perceived target zone (where the strike indicator 128 would have been positioned if folded down) along a target direction 163 with a predetermined non-zero positive or negative side spin 682, 684 applied to the cue ball 162, respectively, such that the object ball 164 rolls in the intended object ball direction 165 after impact with the cue ball 162, wherein the positive or negative side spin 682, 684 causes the ball to be "thrown" corresponding to the positive or negative deviation angle 374, 375, respectively.

In a related embodiment, FIGS. 6A, 6B, and 6C show different scenarios of spin-induced adjustment of the intended object ball direction 165, including:

a) A first scenario 611 with no spin, as shown in FIG. 6A, wherein the deviation angle 374, 375 is zero;

b) A second scenario 612 with a predetermined clockwise right spin 682 of the cue ball 162, as shown in FIG. 6B, which is intended to cause a positive (i.e., clockwise) 20-degree deviation angle 672; and c) A third scenario 613 with a predetermined counter-clockwise left spin 684 of the cue ball 162, as shown in FIG. 6C, which is intended to cause a negative (i.e., counter-clockwise) 20-degree deviation angle 674;

wherein the dotted line representation of the cue ball 162 (which is also colloquially called the "ghost ball"), as shown in FIGS. 6A-6C, illustrates the point of impact between the cue ball 162 and the object ball 164, after the cue ball 162 has impacted the strike indicator 128 and caused the cue sports training device 110 to flick off the object ball 164.

Figure 7A:
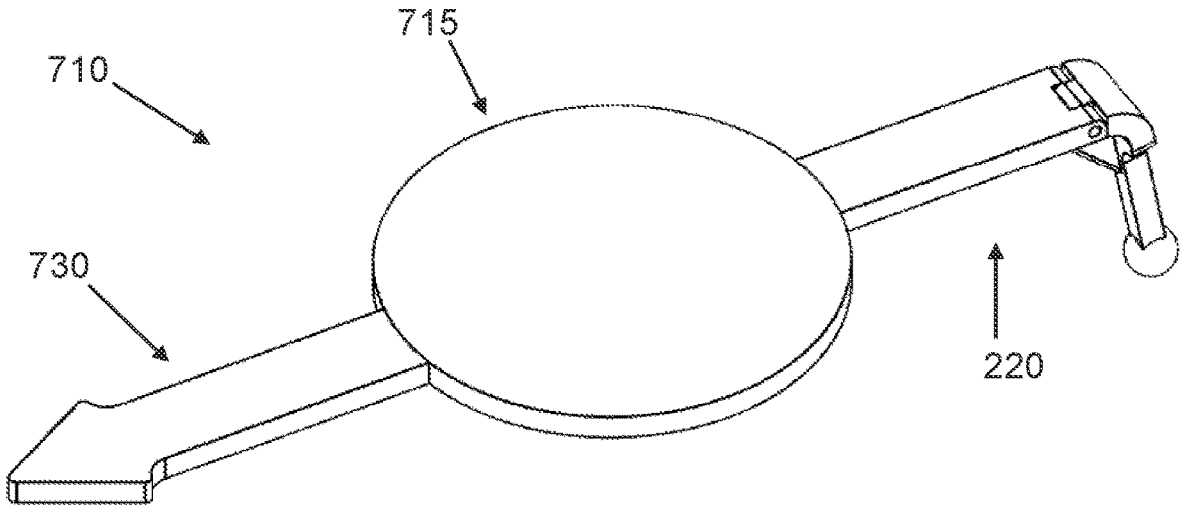
FIG. 7A is a top perspective view of a cue sports training device with a fixed direction member, according to an embodiment of the invention.
Figure 7B:
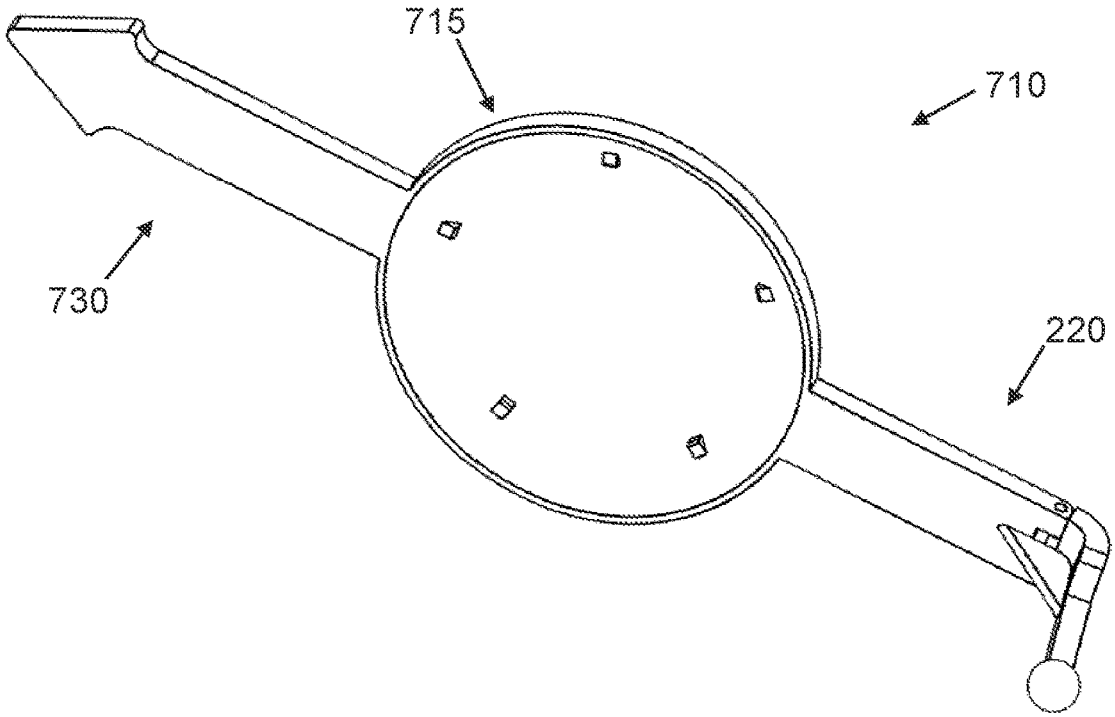
FIG. 7B is a bottom perspective view of a cue sports training device with a fixed direction member, according to an embodiment of the invention.

In a related embodiment, FIGS. 7A and 7B show a version of the cue sports training device 710 with a fixed non-rotatable direction member 730.

Here has thus been described a multitude of embodiments of the cue sports training device 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A cue sports training system, comprising a cue sports training device, which comprises:

a) a ball cap piece, which is configured to be positioned on an object ball; and b) a strike portion, which comprises:

a strike body; and a strike indicator;

wherein a front end of the strike body is connected to a rear end of the ball cap piece; and wherein the strike indicator is connected to a rear end of the strike body; and c) a direction member, which comprises:

a direction body; and a direction indicator;

wherein the direction member is connected to a front end of the ball cap piece;

wherein the direction indicator is connected to an outer end of the direction body; and wherein the direction member is horizontally rotatably connected to the ball cap piece, such that a deviation angle of the direction member is adjustable, whereby adjustment of the deviation angle enables practice with spin-induced adjustment of the intended object ball direction of the object ball;

wherein the direction member further comprises:

a lower ball cap member, which is configured to be positioned on the object ball, wherein the lower ball cap member further comprises:

a lower cap body, which comprises:

an elongated opening, which is shaped as a circle segment;

wherein the strike portion further comprises:

an upper ball cap member, which is positioned on a top of the lower ball cap member, wherein the upper ball cap member further comprises:

an upper cap body, such that a lower peripheral edge of the upper cap body is configured to rest on the lower ball cap member;

a downward protruding member, comprising:

a protruding body, such that a top end of the protruding body is connected to a bottom surface of the upper cap body; and a hook portion, which is connected to a lower end of the protruding body;

such that the hook portion is configured to protrude through the elongated opening of the lower cap body and lock in place on an edge of the elongated opening, such that the hook portion is slidably mounted in the elongated opening, such that the upper ball cap member and the lower ball cap member are horizontally rotatably connected together;

such that an intended object ball direction of the object ball is indicated by the direction indicator of the direction member when a cue ball impacts with the strike indicator after the cue ball follows a target direction to the strike indicator.

2. The cue sports training system of claim 1, wherein the strike portion is configured such that the strike indicator is positionable such that a horizontal center plane of the strike indicator is coincidental with a horizontal center plane of the object ball, when the ball cap piece is positioned on the object ball.

3. The cue sports training system of claim 1, wherein the strike indicator is vertically rotatably connected to the ball cap piece;

such that the strike indicator is vertically rotatable to a folded-down first configuration, such that a horizontal center plane of the strike indicator is coincidental with a horizontal center plane of the object ball, when the ball cap piece is positioned on the object ball; and such that the strike indicator is vertically rotatable to a folded-up second configuration, for practice use without the strike indicator.

4. The cue sports training system of claim 1, wherein the strike body further comprises:

a) a first strike member, which is configured to protrude to a rear of the ball cap piece; and b) a second strike member, wherein an inner end of the second strike member is vertically rotatably connected to an outer end of the first strike member; and such that the strike indicator is connected to an outer end of the second strike member;

such that the second strike member is vertically rotatable to a folded-down first configuration; and such that the second strike member is vertically rotatable to a folded-up second configuration, for practice use without the strike indicator.

5. The cue sports training system of claim 4, wherein the second strike member is configured such that a horizontal center plane of the strike indicator is coincidental with a horizontal center plane of the object ball, when the ball cap piece is positioned on the object ball and the second strike member is rotated to the folded-down first configuration.

6. The cue sports training system of claim 4, wherein the second strike member further comprises:

a) an elongated strike portion, wherein the strike indicator is connected to an outer end of the elongated strike portion;

b) a hinge connector, which is connected to an outer end of the elongated strike portion, wherein the hinge connector is configured to hingedly connect with the outer end of the first strike member; and c) a stop member, which is connected to an outer end of the elongated strike portion below the hinge connector, such that the stop member is configured to stop a rotation of the second strike member when the stop member impacts with the first strike member.

7. The cue sports training system of claim 6, wherein the second strike member further comprises:

a support flange, which is connected between the elongated strike portion and the stop member.

8. The cue sports training system of claim 1, wherein the direction member further comprises:

an outer rim, which is connected to an outer periphery of the lower cap body;

such that the lower peripheral edge of the upper cap body is configured to rest on the outer rim of the lower ball cap member.

9. The cue sports training system of claim 1, wherein the lower ball cap member further comprises:

a plurality of at least three ball support members, which are uniformly mounted on an inside of the lower cap body, to provide support for the object ball.

10. The cue sports training system of claim 1, wherein the lower ball cap member further comprises:

a plurality of angle markers equidistantly positioned around a periphery of the lower ball cap member, such that the angle markers are configured to indicate the deviation angle;

wherein the upper ball cap member further comprises:

a straight position marker, which points along an elongated center axis of the cue sports training device;

such that the deviation angle is measurable by an indicated angle marker, which is indicated by the straight position marker.

11. The cue sports training system of claim 1, wherein the hook portion is configured to be laterally elongated, such that a curvature of the hook portion matches a curvature of the elongated opening of the lower cap body.

12. The cue sports training system of claim 1, further comprising:

the object ball;

wherein the strike portion is configured such that a horizontal separation distance, between a center point of the strike indicator and a closest edge of the object ball, is equal to a radius of the object ball, when the cue sports training device is positioned on the object ball.

13. The cue sports training system of claim 1, further comprising:

the object ball; and the cue ball;

wherein the strike portion is configured such that a horizontal separation distance, between a center point of the strike indicator and a closest edge of the object ball, is equal to a radius of the cue ball, when the cue sports training device is positioned on the object ball.

14. A cue sports training system, comprising a cue sports training device, which comprises:

a) a ball cap piece, which is configured to be positioned on an object ball; and b) a strike portion, which comprises:

a strike indicator;

wherein a front end of the strike portion is connected to a rear end of the ball cap piece; and wherein the strike indicator is positioned on a rear end of the strike portion; and c) a direction member, which comprises:

a direction indicator;

wherein the direction member is connected to a front end of the ball cap piece; and wherein the direction indicator is positioned on a front end of the direction member;

wherein the direction member further comprises:

a lower ball cap member, which is configured to be positioned on the object ball, wherein the lower ball cap member further comprises:

a lower cap body, which comprises:

an elongated opening, which is shaped as a circle segment;

wherein the strike portion further comprises:

an upper ball cap member, which is positioned on a top of the lower ball cap member, wherein the upper ball cap member further comprises:

an upper cap body, such that a lower peripheral edge of the upper cap body is configured to rest on the lower ball cap member;

a downward protruding member, comprising:

a protruding body, such that a top end of the protruding body is connected to a bottom surface of the upper cap body; and a hook portion, which is connected to a lower end of the protruding body;

such that the hook portion is configured to protrude through the elongated opening of the lower cap body and lock in place on an edge of the elongated opening, such that the hook portion is slidably mounted in the elongated opening, such that the upper ball cap member and the lower ball cap member are horizontally rotatably connected together;

such that a deviation angle of the direction member is adjustable, whereby adjustment of the deviation angle enables practice with spin-induced adjustment of the intended object ball direction of the object ball;

such that an intended object ball direction of the object ball is indicated by the direction indicator of the direction member when a cue ball impacts with the strike indicator after the cue ball follows a target direction to the strike indicator.

15. The cue sports training system of claim 14, wherein the strike portion is configured such that the strike indicator is positionable such that a horizontal center plane of the strike indicator is coincidental with a horizontal center plane of the object ball, when the ball cap piece is positioned on the object ball.

16. The cue sports training system of claim 14, wherein the strike portion further comprises:

a) a first strike member, which is configured to protrude to a rear of the ball cap piece; and b) a second strike member, such that an inner end of the second strike member is vertically rotatably connected to an outer end of the first strike member, and such that the strike indicator is connected to an outer end of the second strike member;

such that the second strike member is vertically rotatable to a folded-down first configuration; and such that the second strike member is vertically rotatable to a folded-up second configuration, for use in practice use without the strike indicator.

17. The cue sports training system of claim 16, wherein the second strike member is configured such that a horizontal center plane of the strike indicator is coincidental with a horizontal center plane of the object ball, when the ball cap piece is positioned on the object ball and the second strike member is rotated to the folded-down first configuration.

18. The cue sports training system of claim 16, wherein the second strike member further comprises:

a) an elongated strike portion, wherein the strike indicator is connected to an outer end of the elongated strike portion;

b) a hinge connector, which is connected to an outer end of the elongated strike portion, wherein the hinge connector is configured to hingedly connect with the outer end of the first strike member; and c) a stop member, which is connected to an outer end of the elongated strike portion below the hinge connector, such that the stop member is configured to stop a rotation of the second strike member when the stop member impacts with the first strike member.

19. The cue sports training system of claim 18, wherein the second strike member further comprises:

a support flange, which is connected between the elongated strike portion and the stop member.

20. The cue sports training system of claim 14, wherein the direction member further comprises:

an outer rim, which is connected to an outer periphery of the lower cap body;

such that the lower peripheral edge of the upper cap body is configured to rest on the outer rim of the lower ball cap member.

21. The cue sports training system of claim 14, wherein the lower ball cap member further comprises:

a plurality of at least three ball support members, which are uniformly mounted on an inside of the lower cap body, to provide support for the object ball.

22. The cue sports training system of claim 14, wherein the lower ball cap member further comprises:

a plurality of angle markers equidistantly positioned around a periphery of the lower ball cap member, such that the angle markers are configured to indicate the deviation angle;

wherein the upper ball cap member further comprises:

a straight position marker, which points along an elongated center axis of the cue sports training device;

such that the deviation angle is measurable by an indicated angle marker, which is indicated by the straight position marker.

23. The cue sports training system of claim 14, wherein the hook portion is configured to be laterally elongated, such that a curvature of the hook portion matches a curvature of the elongated opening of the lower cap body.

24. The cue sports training system of claim 14, further comprising:

the object ball;

wherein the strike portion is configured such that a horizontal separation distance, between a center point of the strike indicator and a closest edge of the object ball, is equal to a radius of the object ball, when the cue sports training device is positioned on the object ball.

25. The cue sports training system of claim 14, further comprising:

the object ball; and the cue ball;

wherein the strike portion is configured such that a horizontal separation distance, between a center point of the strike indicator and a closest edge of the object ball, is equal to a radius of the cue ball, when the cue sports training device is positioned on the object ball.

* * * * *